United States Patent [19]

Gold et al.

[11] 4,319,886

[45] Mar. 16, 1982

[54] DENATURANTS FOR ETHYL ALCOHOL

[76] Inventors: Marvin H. Gold, 5050 Dory Way, Fair Oaks, Calif. 95628; Joseph Winkler, 4291 N. River Way, Sacramento, Calif. 95825

[21] Appl. No.: 109,862

[22] Filed: Jan. 7, 1980

[51] Int. Cl.[3] ..... C10L 1/18

[52] U.S. Cl. ..... 44/53; 44/56; 252/365; 252/366

[58] Field of Search ..... 44/53, 56; 252/366, 252/365

[56] References Cited

U.S. PATENT DOCUMENTS

| | | | |
|---|---|---|---|
| 2,192,120 | 2/1940 | Woodhouse | 44/53 |
| 2,192,137 | 2/1940 | Kvalnes | 44/53 |
| 2,196,152 | 4/1940 | Kvalnes | 44/53 |

*Primary Examiner*—Winston A. Douglas
*Assistant Examiner*—J. V. Howard
*Attorney, Agent, or Firm*—Mark C. Jacobs

[57] ABSTRACT

This patent discloses a new class of denaturants for commercial ethyl alcohol, particularly for use in mixtures such as Gasohol. These denaturants are the lower alcoholic esters of monocyclic naphthenic acids and are particularly useful because they can be added in very low concentrations and still provide a noxious flavor and odor to the alcoholic system to make it non-potable.

12 Claims, No Drawings

DENATURANTS FOR ETHYL ALCOHOL

BACKGROUND OF THE INVENTION

This invention relates to the disclosure of a new type of denaturant for ethyl alcohol (ethanol). Because of governmental taxing regulations, it has been the practice to denature ethyl alcohol used for non-beverage purposes so that it becomes unsuitable or unfit for human consumption. There are many commercial or industrial uses for ethyl alcohol where the end-product is non-beverage in nature. As a result a variety of acceptable denaturants have been developed which serve specific purposes. In certain instances where special industrial processes are involved or special medicinals are prepared, specialized denaturants are allowed under governmental licenses. Currently, because of the worldwide decreasing availability of liquid hydrocarbon fuels there has been a revived interest in diluting fuel hydrocarbons, such as gasoline, with a minor amount of absolute ethyl alcohol derived from renewable resources. Mixtures such as this are known as Gasohol. This practice of making fuel mixtures of alcohol-gasoline was established some 40–50 years ago in a number of Eastern European countries, where fuel supplies were less readily available than in the United States. Also the economics for producing fermentation alcohol were favorable because the distillation slops were used in feeding hogs and cattle. Generally the proportions of ethanol used are in the range of 10 to 20%, with the current preferred ratio for Gasohol being of the order of 10%. The main advantages of such a fuel mixture is that it extends the supply of non-renewable hydrocarbon sources with 10% of the fuel deriving from renewable resources as from the fermentation of grain, of agricultural wastes, of industrial wastes, of municipal wastes, etc.

SUMMARY OF THE INVENTION

The Bureau of Alcohol, Tobacco and Firearms, recognizes a number of denaturants which are allowable in fuel formulations. These denaturants are: wood alcohol, methanol, methyl isobutyl ketone, pyronate, acetaldol, kerosine and gasoline. These denaturants, except for the kerosine and gasoline, are all very effective and provide substantial protection against the ready separation of ethanol from a Gasohol mixture so that the alcohol cannot be used for beverage purposes. However methanol is extremely toxic and it is possible to remove the gasoline and kerosine by relatively simple means after extraction with water. The manufacturers of ethanol for use in Gasohol are not only interested in a stable denatured system but they are also vitally concerned with raw material and manufacturing costs. According to our invention, we have discovered a new type of ethanol denaturant, which is effective at very low concentrations and therefore provides the necessary protection at competitively reduced costs and low toxicity hazard. We have discovered that certain alkyl esters of naphthenic acids will provide denaturant activity at very low concentrations in ethanol.

DESCRIPTION OF THE PREFERRED EMBODIMENTS

Naphthenic acids represent a mixture of monocarboxylic acids generally containing a polymethylated cyclopentane ring and an alkyl side chain to which the carboxylic acid group is attached. There are also known certain naphthenic acids which are bi- or polycyclic in nature but for the purposes of this invention we prefer those naphthenic acids which are limited to a single ring structure. The acids we prefer for this invention are usually obtained as a by-product in the refining of certain petroleum fractions, the bulk of which boil in the range of 200°–300° C. Alkaline extraction of such kerosine fractions yield salts of the most useful naphthenic acids. The following formula is merely representational and not necessarily limiting as to structure. However it does represent an accepted structure for the naphthenic acids of major concern to this invention:

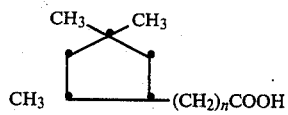

a more generalized structure may be written as:

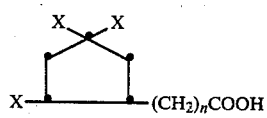

wherein X may be equal to either "H" or "$CH_3$".

Esters which we have found to be effective denaturants for ethyl alcohol, according to our invention, contain a mixture of naphthenic acids where the value of "n" in the above formulae ranges from 1 to 10 and where "X" may equal "H" or "$CH_3$" in one, two or three positions. In other words the most effective acids for contributing denaturing activity in the form of their esters will have molecular weights ranging from about 145 to about 300. We have also found that the methyl and ethyl esters of these naphthenic acids are the most suitable as denaturants. However, it is also within the scope of our invention to use the propyl, butyl or amyl esters as well. Nevertheless for denaturant purposes, we prefer to use either the methyl or ethyl esters or any given ration ratio of a mixture of these two esters.

The lower molecular weight esters of naphthenic acids act as denaturants for ethanol by contributing a very disagreeable taste and odor to the alcohol. The effect of these esters is so powerful that this disagreeable taste is observable, even at dilutions as great as one part in ten million ($1:1\times10^7$). For the practice of our invention we have discovered that a concentration of 0.01 to 1.0% by volume of the naphthenic ester, based upon the total amount of ethanol in the system, provides good denaturant characteristics. However, we prefer to use concentrations of the order of 0.05 to 0.5%, but as noted above, it is quite feasible to use either higher or lower proportions. Thus these esters are particularly useful as denaturants in Gasohol formulations because they can be used at much lower concentrations than other approved denaturants and thereby reduce the costs to the manufacturer. Furthermore they are not readily removed by standard physical or chemical means so that recovery of tax-free, potable alcohol, is greatly inhibited.

The following examples are included for the purpose of illustration and are not intended to limit the scope of this invention.

EXAMPLE 1

PREPARATION OF METHYL NAPHTHENATE

In a 5 liter 3-necked flask, equipped with efficient condenser, stirrer and dropping funnel was placed 1500 g. of commercial naphthenic acid, having an average molecular weight of 250, and 800 ml. of anhydrous methanol. Then with efficient stirring, 500 g. of acetyl chloride was added as rapidly as possible, without allowing the reaction to get out of control (about 40 minutes). Upon completion of the addition the reaction mixture was brought up to boiling and allowed to reflux for another hour. After cooling the mixture was diluted with 2 liters of cool water and shaken well. The upper organic layer was separated and washed well with cold water until neutral. Then the organic layer was dried over sodium sulfate, filtered and distilled under vacuum. A near quantitative yield was recovered of methyl ester boiling over the range of about 100° to 200° C./33 mm., density=0.9500 and refractive index=1.4676.

EXAMPLE 2

PREPARATION OF ETHYL NAPHTHENATE

The preparation of the ethyl ester was conducted in the same manner as in EXAMPLE 1. The ethyl ester was also recovered in excellent yield in about the same boiling range of 100° to 200° C./32 mm., density=0.9325 and refractive index=1.4650.

EXAMPLE 3

DEGUSTATIVE TESTS

Degustative tests were run on both the methyl esters of naphthenic acids prepared in EXAMPLES 1 and 2. These were conducted by making successive ten-fold dilutions of the esters in alcohol until concentrations as low as one part in one million and one part in ten million were attained. At each of these very low concentrations the taste was repugnant and disagreeable

EXAMPLE 4

DENATURANTS AS USED IN GASOHOL

Gasohol samples were prepared by mixing 10% ethanol with 90% unleaded gasoline. Three different mixtures were prepared:

(a) The alcohol contained no denaturant.

(b) The alcohol contained 0.1% ethyl naphthenate.

(c) The alcohol contained 0.2% ethyl naphthenate.

To 100 ml. of each of the above samples was added 10 ml. water. In each case, after thorough shaking the mixtures separated into two layers. The lower aqueous layers containing about a 50% concentration of alcohol were each separated and filtered through a dense filter paper to remove any oily phase. It was found that sufficient ethyl naphthenate was carried over into the aqueous-alcohol layer to contribute a very repugnant flavor even at the 0.1% level and tended to induce vomiting, whereas the sample containing no denaturant had a taste which was bearable even though it retained some gasoline flavor.

What is claimed as new and desired to be secured by Letters Patent of the United States is:

1. A process for rendering commercial ethyl alcohol denatured and non-potable which comprises, adding to ethyl alcohol, at least one denaturing compound selected from the group consisting of $C_1$ to $C_5$ lower alkyl esters of naphthenic acids and mixing said compound with said alcohol to form a miscible mixture.

2. The process of claim 1 wherein the compound being added is the methyl ester of a mixture of naphthenic acids.

3. The process of claim 1 wherein the compound being added is the ethyl ester of a mixture of naphthenic acids.

4. The process of claim 1 wherein the compound added is a mixture of the methyl and ethyl esters of naphthenic acids.

5. The process of claim 1 wherein said denaturing compound is added in the range of between 0.01 to 1.0% by volume.

6. The product of a non-potable commercial ethyl alcohol which is denatured with an alcoholic ester of naphthenic acids.

7. The product of a non-potable commercial ethyl alcohol as in claim 6 wherein the denaturant is the methyl ester of naphthenic acids.

8. The product of a non-potable commercial ethyl alcohol as in claim 6 wherein the denaturant is the ethyl ester of naphthenic acids.

9. A non-potable combination of ethyl alcohol denatured with a mixture of methyl and ethyl esters of napthenic acids.

10. A non-potable combination as in claim 6 wherein the alcoholic esther of naphthenic acids is added in an amount of from 0.01 to 1.0% by volume of ethyl alcohol.

11. A gasoline-alcohol mixture for use as a motorcar fuel wherein said alcohol component has been denatured by the addition of at least one denaturing compound selected from the group consisting of $C_1$–$C_5$ lower alkyl esters of napthenic acids.

12. The gasoline alcohol mixture of claim 11 wherein said denaturing compound is the ethyl esther of napthenic acids.

* * * * *